United States Patent [19]

Strom

[11] 4,333,039

[45] Jun. 1, 1982

[54] PILOT DRIVER FOR PLASMA DISPLAY DEVICE

[75] Inventor: Richard A. Strom, Eagan, Minn.

[73] Assignee: Control Data Corporation, Minneapolis, Minn.

[21] Appl. No.: 208,738

[22] Filed: Nov. 20, 1980

[51] Int. Cl.[3] ..... H05B 41/14

[52] U.S. Cl. ..... 315/169.4; 340/714

[58] Field of Search ..... 315/169.4; 340/713, 340/714

[56] References Cited

U.S. PATENT DOCUMENTS

| | | | |
|---|---|---|---|
| 3,750,159 | 7/1973 | Wojcik | 340/324 M |
| 3,786,484 | 1/1974 | Miavecz | 340/324 M |
| 3,879,634 | 4/1975 | Pfaender et al. | 315/169 TV |
| 4,077,033 | 2/1978 | Strom | 340/324 M |
| 4,091,309 | 5/1978 | Strom | 315/169 TV |
| 4,180,762 | 12/1979 | Weber | 315/169.4 |

*Primary Examiner*—Eugene R. La Roche

*Attorney, Agent, or Firm*—William J. McGinnis; Joseph A. Genovese

[57] ABSTRACT

A pilot cell driver for a capacitive memory plasma display device having three output states: high, low, and floating. The floating state of the pilot cell driver is used in combination with a feedback of the plasma display panel sustain voltage to create a third voltage level on the pilot cell drive line for use in rewriting the pilot cells. The pilot cell driver is comprised of a pull-up switch and pull-down switch. After the pull-up switch is activated for a short period of time, the output of the pilot cell driver relaxes to the floating state. The floating state voltage is achieved, for example, on a vertically oriented pilot cell drive line by coupling to a horizontal sustain drive voltage which switches from the pull-up voltage to the pull-down voltage during the relaxation time of the pilot cell driver. By capacitively coupling the horizontal sustain voltage to the vertical pilot cell drive electrode, the floating state voltage is achieved.

9 Claims, 4 Drawing Figures

PILOT DRIVER FOR PLASMA DISPLAY DEVICE

BACKGROUND OF THE INVENTION

This invention relates to pilot cell drive electronics for plasma display panels. The A.C. (alternative current) plasma display capacitive memory panel is well-known in the display technology art at this time. Plasma display pilot cell techniques for such panels are also well-known. This invention relates in particular to a pilot cell drive system having three output states, particularly, a high, pull-up state, a low, pull-down state, and a relaxation, floating state which allows the achievement of a pilot cell electrode voltage which is not directly supplied by an external voltage source.

In the prior art, pilot cells have been fired coincident with the write pulse to achieve photon conditioning and provide for reliable writing of isolated display cells. Pilot cells have been operated in the bistable mode and in some cases have had additional write pulses applied to them to initiate pilot cell discharges and to maintain the lighted condition of pilot cells following a bulk erase operation or other disturbing condition in the operation of the display panel. The system described in this application presents all of these operational features. The present invention provides for a simple pull-up/pull-down pilot cell driver rather than a comparatively complex, multistate pilot cell driver. Additional pilot cell writing pulse voltages for rewriting of pilot cells is derived from the opposite axis sustain drive voltage through a feedback or coupling network. The operation of the pilot cell driver is as a result of allowing the output of the pilot cell driver to float during a portion of the pilot cell drive cycle and controlling the feedback of the sustain voltage so that the appropriate rewrite pulse amplitude is achieved.

Known to applicant and related to the present invention are three pertinent prior art patents. The first patent is U.S. Pat. No. 3,750,159 issued July 31, 1973 and entitled, "Bulk Erase System for Gas Discharge Display Panels." In this patent, a bulk erase operation in the display panel automatically erases all pilot cells because the pilot cells are operating in a sustaining mode just as are all of the display panel visible elements. The pilot cell write drivers float on the sustain driver output and each pilot cell write driver is capable of supplying a full write amplitude pulse. Following a bulk erase the pilot write drivers rewrite the pilot elements. This patent does not anticipate the present invention. The present invention does not use a pilot cell write driver floating on a sustain driver output. The patent does not use feedback from the opposite axis sustain driver to provide the rewrite voltage.

Another pertinent patent known to applicant is U.S. Pat. No. 3,786,484 issued Jan. 15, 1974 and entitled, "Border Control System for Gas Discharge Display Panels." This patent shows border elements, otherwise called pilot cells, operating in a sustain voltage range and capable of being written at a selected time by increasing the direct current supply voltage input to the border sustainer. This patent does not anticipate the present invention because it shows the use of multiple voltages being generated by the pilot cell drive system.

The third pertinent patent known to applicant is U.S. Pat. No. 3,879,634 issued Apr. 22, 1975 and entitled, "Manufacture and Operation of Gas Discharge Panel." This patent shows the use of pilot cells in a plasma display panel and describes the use of such cells to maintain photon conditioning of a plasma display panel. This patent does not anticipate the present system of using a separate pilot cell driver according to the disclosure of this application.

Applicant's earlier U.S. Pat. No's. 4,077,033 issued Feb. 28, 1978 and 4,091,309 issued May 23, 1978 contain additional background information relating to the subject of A.C. plasma display technology. The disclosure of these patents is hereby incorporated in this application by reference.

SUMMARY OF THE INVENTION

The present invention is a pilot cell driver for a capacitive memory type plasma display. The driver according to the present invention is illustrated by an embodiment for use on a single axis of a plasma display panel. A pilot cell driver according to the present invention may be used to drive both axes of an X-Y plasma display panel. For the purposes of illustrating the invention, the pilot cell driver is described as a vertical axis pilot cell driver and is described in cooperation with a horizontal axis sustain driver which provides a source of feedback voltage from a sustain bus. The feedback voltage is illustratively described as a capacitive feedback voltage for providing a third voltage state for the pilot cell drive line during a floating or relaxation condition of the pilot cell driver. A pilot cell driver according to the present invention has a pull-up switch and a source of pull-up voltage together with a pull-down switch and a source of pull-down voltage, illustratively described as a ground reference voltage in this application. The floating condition of the pilot cell driver consists of a relaxation period after the pull-up switch is momentarily actuated and allowed to relax at the same time the sustain bus voltage is providing a source of feedback voltage, opposite in plurality to an initial voltage.

Illustratively, the pull-up switch of the present invention may consist of a bipolar pull-up transistor coupled to a pilot cell pull-up trigger by means of an isolation transformer. A pilot pull-down switch, which does not need an isolation means from its trigger, may consist of a bipolar pull-down transistor coupled by means of diodes to the pull-up transistor and the pilot cell electrodes. The diodes help in shutting off the pilot cell pull-up switch during a pull-down cycle. The nature of the bipolar transistor, illustratively described, is such that after the pull-up switch is triggered, and the trigger signal turns off, the bipolar transistor does not immediately shut off but relaxes over a period of time to the off condition. Thus, the floating voltage condition is achieved as the pull-up bipolar transistor is relaxing to an off condition and as a result of the feedback voltage from the sustain bus driver being capacitively coupled to the pilot cell electrode.

IN THE FIGURES

FIG. 1 is a diagrammatic illustration of a plasma display panel, a horizontal sustain driver coupled to the plasma display panel and a pilot cell drive system according to the present invention.

DESCRIPTION OF THE PREFERRED EMBODIMENTS

Figure 7:
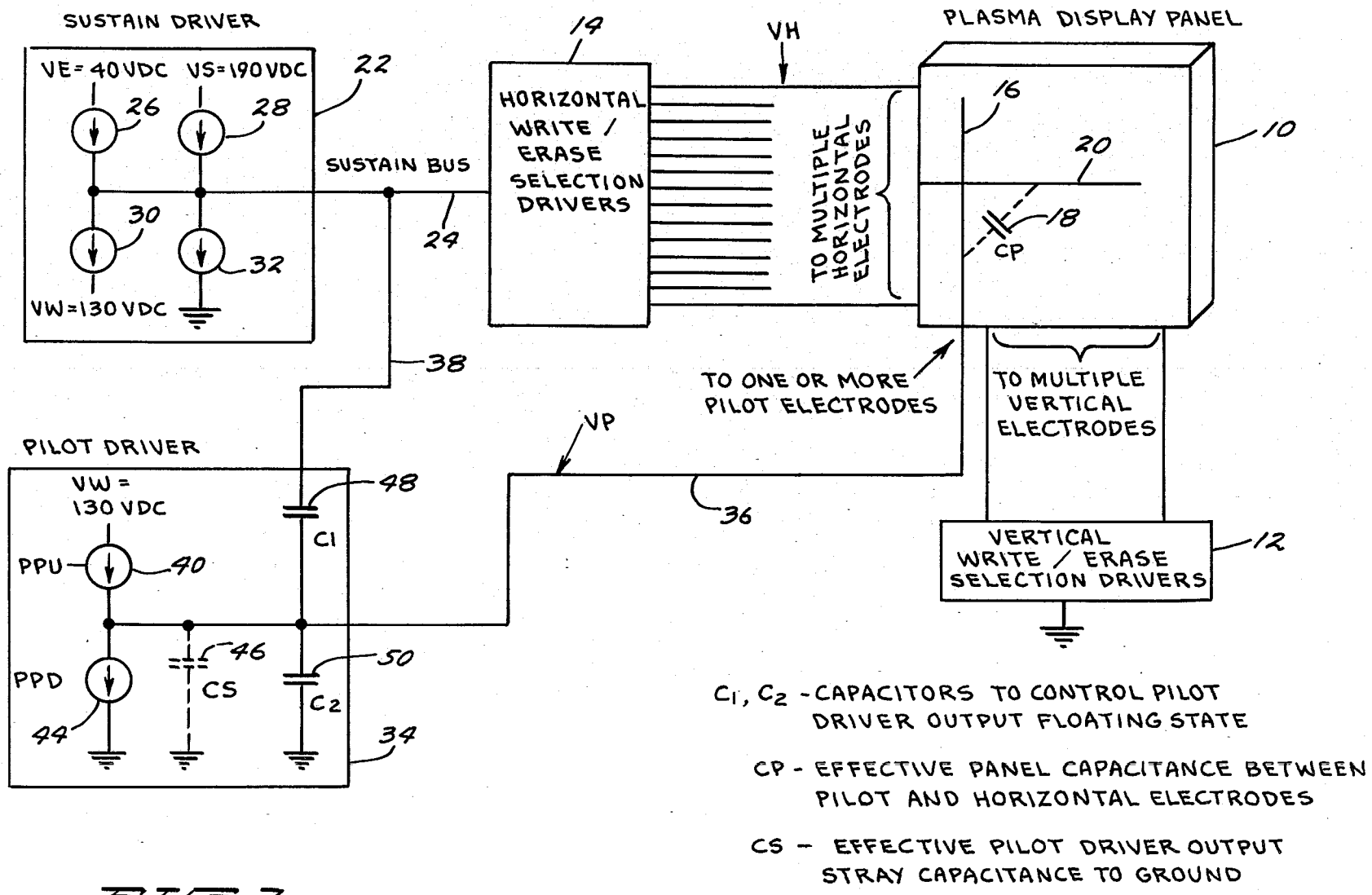

Referring now to FIG. 1, a capacitive memory plasma display panel 10, shown diagrammatically, is provided with a vertical write/erase selection driver unit 12 to drive a plurality of vertical electrodes or drive lines, shown diagrammatically. A horizontal write/erase selection driver unit 14 provides the horizontal voltages to the various horizontal electrodes. The plasma display panel also has a plurality of vertically aligned pilot cells driven by at least one pilot cell electrode 16. The characteristics of the pilot cell electrode include, particularly, that the pilot cell electrode 16 exhibits a capacitive coupling with all of the other elements of the plasma display panel. This is illustrated by means of a characterizing capacitance 18, shown for diagrammatic purposes only, between the pilot cell electrode 16 and a single, illustrative, horizontal electrode 20 in the display panel. Capacitor 18 is referred to as the $C_P$ capacitance in discussion of this characteristic of the plasma display panel.

The horizontal electrodes are driven by horizontal voltages, herein characterized as $V_H$. The pilot cell electrode 16 is driven by a voltage herein characterized as $V_P$. The plasma display panel herein contemplated has a sustain driver voltage which is supplied by a sustain driver unit 22 which drives a sustain bus 24 which is coupled to the horizontal write/erase selection driver unit 14. The system herein contemplated is one in which the horizontal write and erase drivers are referenced to the horizontal sustain voltage bus 24.

The sustain driver may be simply characterized as consisting of four switches for pulling the sustain bus to the four voltages necessary for appropriately driving a plasma display panel. These four switches 26, 28, 30 and 32 are coupled, respectively, to a source of erase voltage, sustain voltage, write voltage and a ground reference. The erase voltage, characterized as $V_E$ may be 40 volts for example. The sustain voltage herein characterized as $V_S$ may be approximately 190 volts. The write voltage herein characterized as $V_W$ may be 130 volts, for example. A pilot cell driver unit 34 according to the present invention is connected with the pilot cell bus 36 which in turn is connected with the pilot electrode 16, previously described. In addition, the sustain bus 24 is coupled by means of a feedback bus 38 to the pilot cell driver.

The pilot cell driver according to the present invention consists of a pilot pull-up (PPU) switch 40 connected to a source of pilot writing voltage herein characterized as $V_W$ which is 130 volts and is the same as the write voltage $V_W$ supplied to the sustain driver 22. The pilot pull-up switch 40 is connected to an internal pilot driver bus 42 which in turn is connected externally to the pilot cell bus 36. In addition, the pilot driver has a pilot pull-down (PPD) switch 44 connected to the internal bus 42 and a source of pull-down voltage which may typically be a ground reference. However, the pull-down voltage for a pilot driver does not have to be a ground reference voltage. The internal capacitance of the pilot driver, which consists of the aggregate of the internal capacitances of the various transistor switches and other elements of the pilot cell driver, is represented in FIG. 1 by capacitor 46 with a characteristic capacitance $C_S$. In addition, a coupling capacitor 48, with a capacitance characterized as $C_1$, is connected between the feedback bus 38 and the internal bus 42 of the pilot driver. Finally, a capacitor 50, characterized by the capacitance $C_2$, is coupled between the internal bus 42 and a ground reference.

Figure 2:
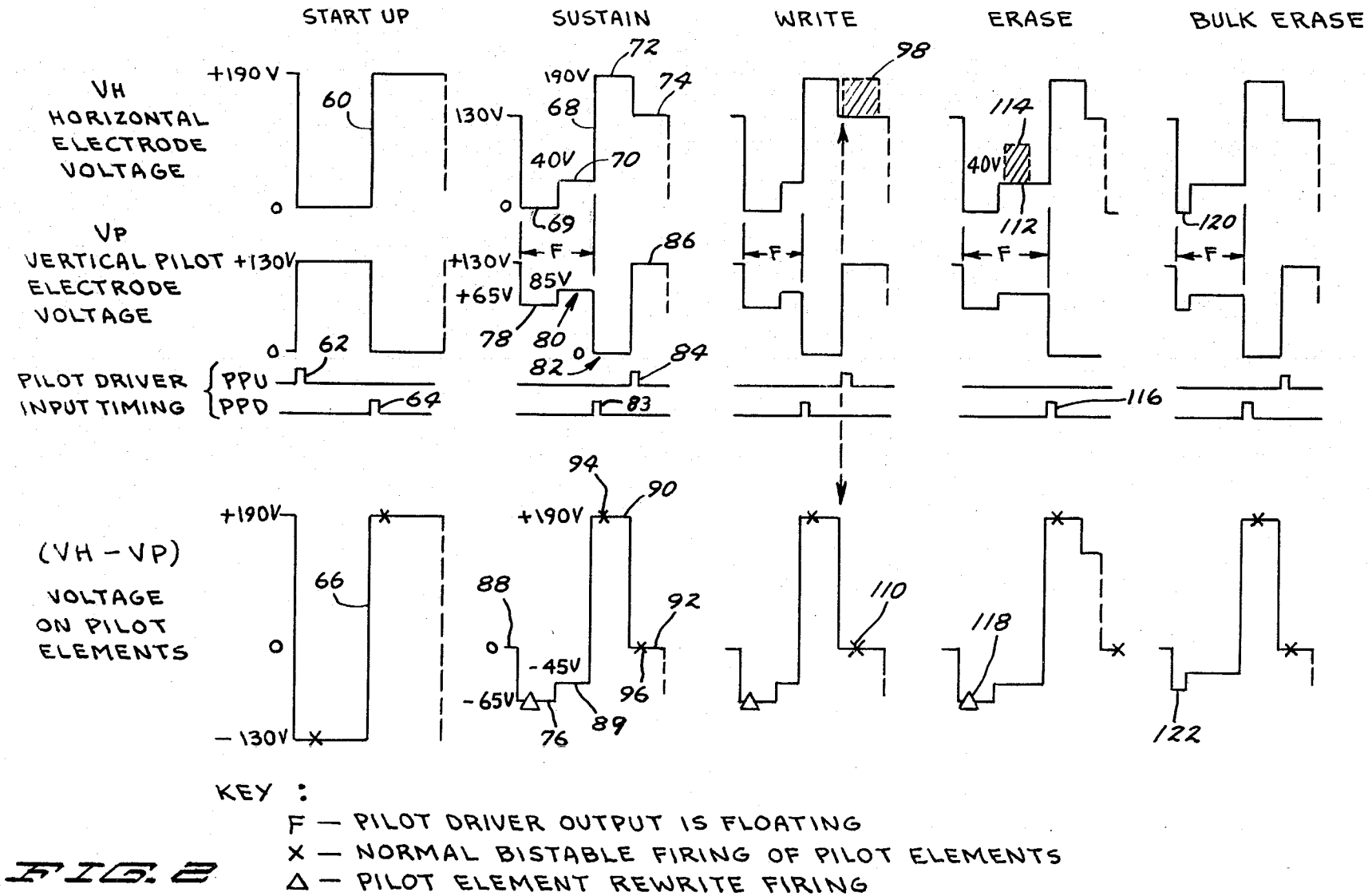
FIG. 2 is an illustrative diagram of the horizontal electrode voltages, the pilot cell electrode voltages and the voltages actually applied to the pilot cell elements for various plasma display panel operations along a time scale.

FIG. 2 is a diagrammatic illustration of the voltage waveform characteristics of the plasma display panel of FIG. 1 in the basic operating modes. The voltages shown are by way of example, only, but are typical and appropriate for plasma display panels. There are five basic plasma display operational modes shown in FIG. 2. These modes are the start-up cycle, the sustain cycle, the write cycle, the erase cycle and the bulk erase cycle. Each of these cycles are used in various combinations to produce the display of information on the plasma display panel. The time duration of each of these cycles is approximately 20 microseconds. The start-up cycle is used when the display panel is first turned on to initiate pilot cell discharges. The sustain waveform is applied to all of the panel electrodes until such time as the panel is to be addressed. A write cycle is used to selectively apply a pulse to one of the display elements and cause that element to become ignited. The erase pulse is used to selectively erase an already discharging display element. The bulk erase cycle is applied to nonselectively erase all of the lit display elements of the panel. The horizontal electrode voltage $V_H$ is generated by the sustain driver in combination with the horizontal write/erase selection drivers and is applied to all horizontal electrodes on the display panel.

The vertical pilot cell electrode voltage $V_P$ is generated by the pilot driver. This waveform is modified, during the floating condition, by the feedback voltages that are coupled both through the plasma panel capacitance ($C_P$) 18 and through the external feedback capacitor ($C_1$) 48. This composite waveform 36 ($V_P$) is applied to one or more pilot electrodes although only one is shown in this embodiment of the invention. The input timing or trigger signals, the pilot pull-up (PPU) signal and the pilot pull-down (PPD) signal, are applied, respectively, to the pull-up switch 40 and the pull-down switch 44 of the pilot cell driver. The voltage that is seen by the pilot cell elements within the panel is the algebraic combination of the horizontal voltage $V_H$ and the vertical pilot voltage $V_P$, that is, ($V_H$ minus $V_P$). These waveforms are also shown for each of the operational display modes in FIG. 2.

During the display panel start-up cycle, only the pull-up switch 28 and the pull-down switch 32 of the sustain driver are used to create a rectangular pulse shape 60. The PPU and PPD switches in the pilot driver, 40 and 44 respectively, are turned on and off with trigger or timing pulses 62 and 64. The output voltage of the pilot driver, $V_P$, when combined with the start-up pulse 60 from the sustain driver creates a large, rectangular peak-to-peak voltage pulse 66 across the pilot elements.

By timing the pilot driver 34 and the sustain driver 22 in this way during the start-up cycle, a voltage that is in excess of the normal sustain voltage is applied to the pilot elements. This voltage makes the pilot cells start more rapidly during the initial power-up of the display panel.

A complex waveform having several voltage levels is applied by the sustain driver during the sustain cycle.

The four levels of the sustain waveform are created by turning on and off the four switches within the sustain driver 22. When switch 32, is turned on, the voltage on the sustain bus goes to zero at 69 on the waveform of FIG. 2. Switch 26 is then turned on which will pull the sustain bus voltage up to 40 volts at 70 on the waveform. Then, switch 28 is turned on which brings the pulse voltage up to 190 volts at 72 on the waveform. The voltage is then brought back down to a 130 volt level at 74 on the waveform by turning on switch 30.

During the first two portions of the sustain waveform, 69 and 70, the pilot driver output bus 42 is in a floating state and the voltage $V_P$ on line 36 is generated by the feedback paths within the circuit. These feedback conditions are determined by the electrode capacitance $C_P$ through the plasma display panel shown by phantom capacitor 18 and a capacitor 48 added as a capacitor direct feedback path from the sustain bus 24 to bus 42 of the pilot driver.

Figure 3:
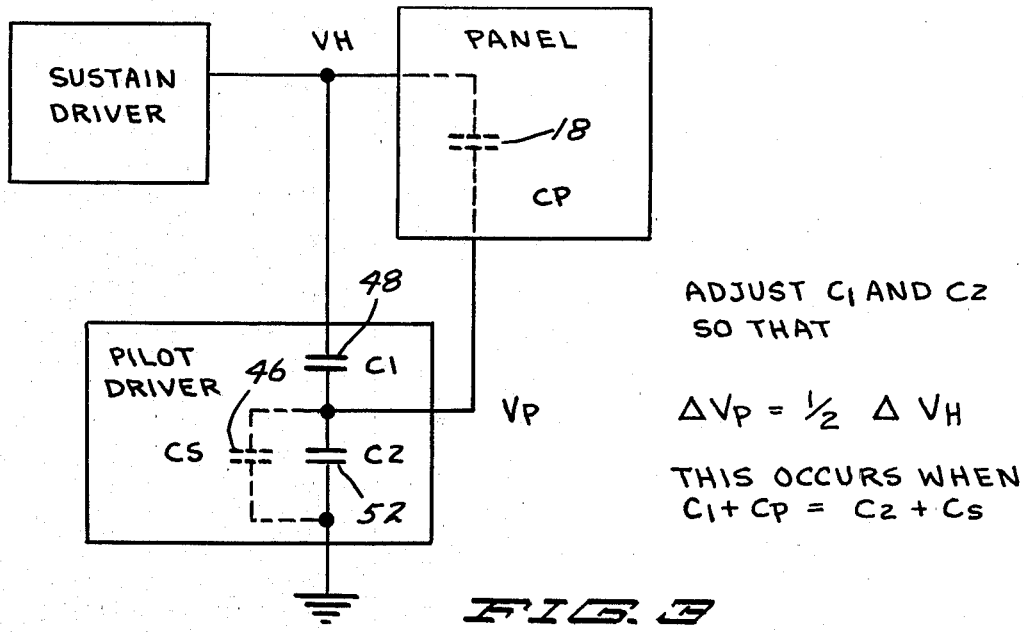
FIG. 3 is a diagram showing the effective capacitances which provide the feedback voltage from the sustain driver bus to the the pilot cell electrode.

When the sustain bus makes the voltage transition from 130 volts to zero at level 69, the voltage at the output of the pilot driver will make a transition from 130 volts to 65 volts. This transition is determined by a feedback capacitance which is the parallel combination of the capacitance $C_P$, shown as capacitor 18 in FIG. 1 and in simplified form in FIG. 3 and capacitance $C_1$, shown as capacitor 48 in FIGS. 1 and 3. The pilot driver has its internal capacitance, $C_S$, shown in FIG. 1 as a phantom capacitor 46 and a discrete additional capacitor ($C_2$) 50. Both of these capacitors represent capacitance relative to ground. These are also shown in the simplified FIG. 3, using the same reference numerals.

The voltage at the output of the pilot driver, $V_P$, during the floating condition is proportional to the change in voltage that occurs on the sustain bus 24. The capacitance $C_1$, that controls this feedback is adjusted such that the voltage $V_P$ will be approximately one-half the change in voltage that is occurring on sustain bus 24. This is shown in the formula in FIG. 3: delta $V_P$, the change in the pilot voltage, equals one-half delta $V_H$, which is the change in the applied sustain bus voltage. To meet this condition, it is necessary that: $C_1+C_P=C_2+C_S$. When this condition is met, the change in pilot voltage will produce a pulse shown in FIG. 2, at level 76, which in relation to the following sustain pulses, will appear as a writing pulse.

The output of the pilot driver during the first portion of the sustain cycle therefore goes from 130 to 65 volts at level 78 and then makes a transition when the switch 26 of the sustain driver pulls to 40 volts. At this time, the transition seen at the output of the pilot driver goes from 65 to 85 volts, to level 80 in FIG. 2. This is a 20 volt transition determined by the ratio of the feedback capacitor. The feedback circuit creates a capacitive voltage divider based on internal capacitance ($C_P$ and $C_S$) and discrete capacitors 48 and 50. This voltage divider determines the change of voltage on pilot driver bus 36 which is half the change of voltage on the sustain bus.

The triangle symbol shown at level 76 represents the time at which the pilot element will fire if it has not been firing in the sustaining mode as represented by the X symbol. Thus, a pilot cell, if it is off, will fire once at the triangle symbol and then continue to fire in the bistable mode at the X symbol shown at 94 and 96.

Following the voltage level 80 in FIG. 2, the pilot pull-down switch 44 is turned on by trigger pulse 83 and brings the output of the pilot driver to zero volts at level 82. The pilot pull-up trigger pulse 84 in the Fig. is applied to cause the output of the pilot driver to go to its high state, 130 volts at voltage level 86. This is done at the same time as the sustain driver switches are switching from voltage level 72 to voltage level 74 as shown. The result of this combination is a voltage waveform across the pilot elements which is shown as $V_H-V_P$ in FIG. 2. The voltage pulse begins at zero at level 88, and switches to minus 65 volts at level 76. The voltage then rises to minus 45 volts at level 89, and next makes a transition to plus 190 volts at level 90 in the Fig. The final transition during the sustain cycle brings the voltage applied to the pilot elements back to zero at level 92.

The X symbol at 94 and 96 in FIG. 2 of the pilot element voltage waveform during the sustain cycle represents the normal, bistable firing times of the pilot elements. This means that if the pilot elements are lit, they will be firing a sustain cycle at the times represented by the X, at 94 and 96. If the pilot elements are not lit, they will be fired by the minus 65 volt pulse, at 76 in the Fig. The waveshape is a repeated waveshape and therefore pulse 76 will occur once each sustain cycle. If for some reason the pilot cell is off because of some other voltage disturbance, like a bulk erase operation, pulse 76 will cause the cell to fire and the cell will then continue to be sustained at times 94 and 96 in the Fig.

The output of the sustain driver during the write cycle is very similar to the waveshape that is used during a sustain cycle. The main difference in a write cycle is that a half-select write pulse shown at 98 is applied at the time the pulse level drops from its 190 volt level down to the 130 volt level. This is a selective pulse which will occur only on the drive lines which will have information written into them in the active part of the display panel. As far as the pilot voltage is concerned, a very similar waveform is created at the output of the pilot driver and the resultant operation of the pilot elements will be the same as if the panel were in the sustain mode.

The primary purpose of the pilot cell elements in a plasma display panel is to have them fire at the same time as the selective write pulse is applied to the panel. The firing of the pilot elements will supply photons to enhance the reliability of the writing operation. This occurs when the pilot elements fire at approximately the same time as the beginning of the selective write pulse. In FIG. 2 the pilot discharge indicated by the X symbol at 110 occurs close in time to the leading edge of the selective write pulse at 98.

During the erase cycle, the timing is similar to the sustain cycle and the write cycle except that the pulse time at 112 at the 40 volt level is longer so that there will be sufficient time for the half-select erase pulse (shown by pulse 114) to achieve the proper erase condition in the selected cell. Because this additional time is required during the first part of the erase cycle, it is necessary to alter slightly the operation of the pilot driver. Only one of the input timing or trigger pulses to the pilot driver is used during the erase cycle. This is the pilot pull-down trigger pulse at 116. It is not necessary that the pilot pull-up trigger pulse be used during the erase cycle to achieve proper operation of the pilot elements. The reason for this is that it is not important that the pilot elements fire during the time the erase pulse is applied because erasing does not require the same conditioning that the write cycle requires. The erase cycle still has the same rewrite pulse occurring at the beginning; namely, pulse 118. If the pilot elements are not lit, this rewrite pulse will cause them to write and they will continue to be sustained at the X symbol locations shown in the Fig.

The operation of the pilot driver during the bulk erase cycle is similar to the operation during the sustain cycle and the write cycle. The bulk erase cycle is used to extinguish all of the display elements within the active part of the display panel, but is not intended to extinguish the pilot elements. The bulk erase cycle is generated by changing the timing of the switches within the sustain driver so that a narrow pulse 120 occurs at the beginning of the bulk erase cycle. Except for this timing change, the pilot cell operation during the bulk erase cycle will be identical to the operation during the sustain cycle.

The rewrite pulse that results from the shortened timing sequence of the sustain output shown at 122, will not be adequate for rewriting the pilot elements in case the pilot elements have been erased or are out for some other reason, independent of the bulk erase operation. Since the bulk erase is only a single event and is not applied repetitively, the rewrite pulse that is at the beginning of any of the other cycles will serve to rewrite the pilot elements and thus restore the operation that is required.

Figure 4:
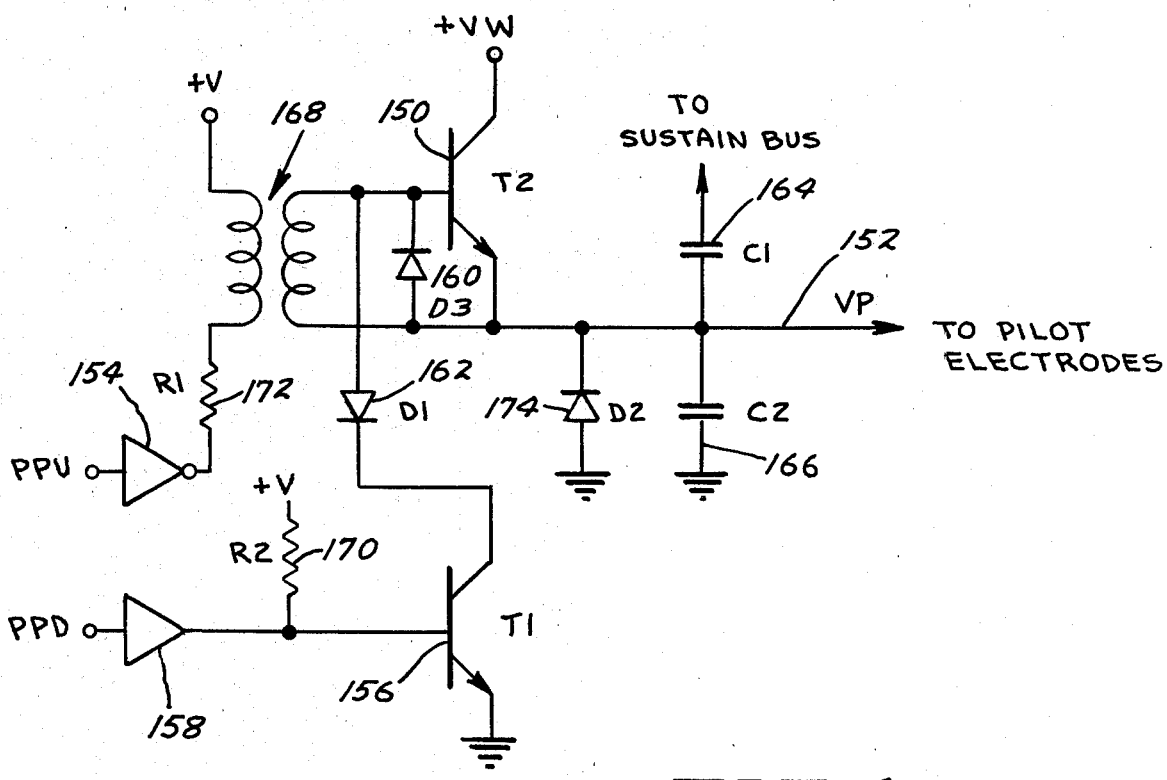
FIG. 4 is an illustrative preferred embodiment of a pilot cell driver according to the present invention.

FIG. 4 is a schematic diagram of a pilot drive unit that can be used in the pilot cell system described in this patent. The primary requirement for the pilot cell driver is that it be capable of driving its output actively to a high state of approximately 130 volts or to drive the output to a low state which is zero or ground or to allow the output of the driver to be in a floating state so that the voltage condition on the pilot cell bus can be determined by the externally coupled feedback to the voltage supplied by the sustain driver on the horizontal axis of the display.

Referring now to FIG. 4, transistor 150 will pull the output line 152 of the pilot driver to the high voltage level $V_W$ when the transistor is turned on. Transistor 150 is turned on as the result of a pilot pull-up pulse being applied to gate 154. This pulls current through the isolation transformer 168 and thus drives the base of transistor 150 to turn it on.

Transistor 156 is the pull-down transistor switch. This switch is activated when the pilot pull-down logic signal is applied to gate 158 which drives the base of transistor 156. The output line 152 will be pulled down through diode 160 and diode 162. This diode interconnection allows the base to emitter junction of transistor 150 to be reverse biased during the pull-down time, thus aiding the turn off of transistor 150 by helping to reduce the storage time of the transistor.

Capacitor 164, is connected from output line 152 to the output of the sustain driver bus 24. Capacitor 166 is connected from pilot driver output line 152 to ground. These two capacitors allow adjustment for the internal capacitance of the panel, $C_P$, and the stray capacitance, $C_S$, of the pilot driver. Since $C_P$ and $C_S$ may differ slightly between one system and another, individual differences in capacitance can be compensated.

Transformer 168 serves as an isolation transformer between the ground referenced PPU driver 154 and switch 150. Resistor 172 in FIG. 4 controls the base current drive for transistor 150. Resistor 170 controls the base current drive to transistor 156.

By way of example, only, transistors 150 and 156 may be Unitrode model UPT 313 transistors. Resistors 170 and 172 may be 180 ohms. Capacitor 164 may be 100 picofarads and capacitor 166 may be 68 picofarads.

What is claimed is:

1. A plasma display pilot cell driver associated with at least one axis of a plasma display device having pilot cells with at least one pilot cell drive electrode comprising:

a pilot cell driver output bus for connection with the pilot cell drive electrode, a pull-up switch connected with a first source of voltage, and to said pilot cell driver output bus, a pull-down switch connected with a second source of voltage, and to said pilot cell driver output bus, means for allowing the output voltage on said pilot cell driver output bus to float with the voltage applied to said pilot cell drive electrodes, and means for supplying opposite axis sustain voltage feedback to said pilot cell driver output bus.

2. The pilot cell driver of claim 1 wherein said pull-up and said pull-down switches are bipolar transistor switches.

3. The pilot cell driver of claim 2 wherein said feedback voltage is coupled to the output of said driver during a relaxation period following the momentary actuation of said pull-up bipolar transistor switch to achieve a floating output voltage condition.

4. The pilot cell driver of claim 1 wherein a capacitor is used to couple an opposite axis sustain voltage feedback to said pilot cell drive electrodes to achieve said floating output voltage condition.

5. The pilot cell driver of claim 4 wherein said capacitor acts to create a voltage divider network for said floating output voltage together with the internal capacitance of said plasma display device and of the pilot cell driver.

6. The pilot cell driver of claim 5 wherein the floating output voltage of the pilot cell driver ($V_P$) is defined by a relationship to the opposite axis sustain voltage ($V_H$) as follows:

$$\Delta V_P = \tfrac{1}{2}\Delta V_H.$$

7. The pilot cell driver of claim 6 wherein the following relationship exists:

$$C_1 + C_p = C_2 + C_s$$

where:

$C_1$ is the value of capacitor providing feedback from the opposite axis sustain voltage, $C_p$ is the internal capacitance of the plasma display device, $C_2$ is a capacitor coupling the pilot cell driver output to a ground reference and $C_s$ is the internal capacitance of the pilot cell driver.

8. The pilot cell driver of claim 7 wherein the pull-down switch is connected with a ground reference.

9. A plasma display pilot cell driver associated with one axis of a plasma display device comprising:

a pilot cell driver output bus, a bipolar pull-up transistor switch connected from a source of write voltage to said bus, a pilot pull-up trigger means connected to actuate said pull-up transistor switch, a bipolar pull-down transistor switch connected to a reference voltage source, a pilot pull-down trigger means connected to actuate said pull-down transistor switch, diode biasing means connecting said pull-down transistor switch to the base of said transistor pull-up switch and to said bus for shutting off said pull-up switch upon actuation of said pull-down switch, and means for capacitively coupling said output bus to the opposite axis sustain driver so that the voltage on said output bus is a floating voltage during a relaxation period following momentary actuation of said pull-up switch when said pull-down switch is not actuated.

* * * * *